US005788032A

United States Patent [19]

Krulik

[11] Patent Number: 5,788,032

[45] Date of Patent: Aug. 4, 1998

[54] ARTICLE OF LUGGAGE WITH EXTERIOR POCKET FOR ATTACHMENT TO A WHEELED CASE

[75] Inventor: Richard J. Krulik, Dix Hills, N.Y.

[73] Assignee: United States Luggage, L.P., Hauppauge, N.Y.

[21] Appl. No.: 773,657

[22] Filed: Dec. 24, 1996

[51] Int. Cl.[6] ..... A45C 5/14; A45C 13/10; A45C 13/28; A45C 13/30

[52] U.S. Cl. ..... 190/108; 190/18 A; 190/102; 190/115; 190/111; 150/107; 150/111

[58] Field of Search ..... 190/18 A, 39, 190/102, 108, 115, 111; 150/107, 111

[56] References Cited

U.S. PATENT DOCUMENTS

| | | | |
|---|---|---|---|
| 2,721,596 | 10/1955 | Danneil | 150/107 |
| 4,094,391 | 6/1978 | Ratchford | 190/115 X |
| 4,887,751 | 12/1989 | Lehman | 190/18 A X |
| 4,901,897 | 2/1990 | Briggs et al. | 206/287.1 X |
| 5,197,525 | 3/1993 | Cantor | 190/108 X |
| 5,253,739 | 10/1993 | King | 190/115 X |
| 5,353,900 | 10/1994 | Stilley | 190/115 X |
| 5,373,685 | 12/1994 | Plath | 190/115 X |
| 5,509,515 | 4/1996 | Guo | 190/113 X |
| 5,630,521 | 5/1997 | Waddell et al. | 190/115 X |
| 5,660,476 | 8/1997 | Decoster | 190/108 X |

*Primary Examiner*—Sue A. Weaver
*Attorney, Agent, or Firm*—Abelman, Frayne & Schwab

[57] ABSTRACT

An auxiliary hand article of luggage is disclosed, which includes an exteriorly accessible pocket which can be readily converted to a strap for temporarily securing the auxiliary hand article to the U-shaped handle extending upward from the top of a separate article of wheeled luggage. The externally accessible pocket is readily converted into a securement strap by the opening of a closure, which may be in the form of a zipper.

22 Claims, 3 Drawing Sheets

FIG. 3
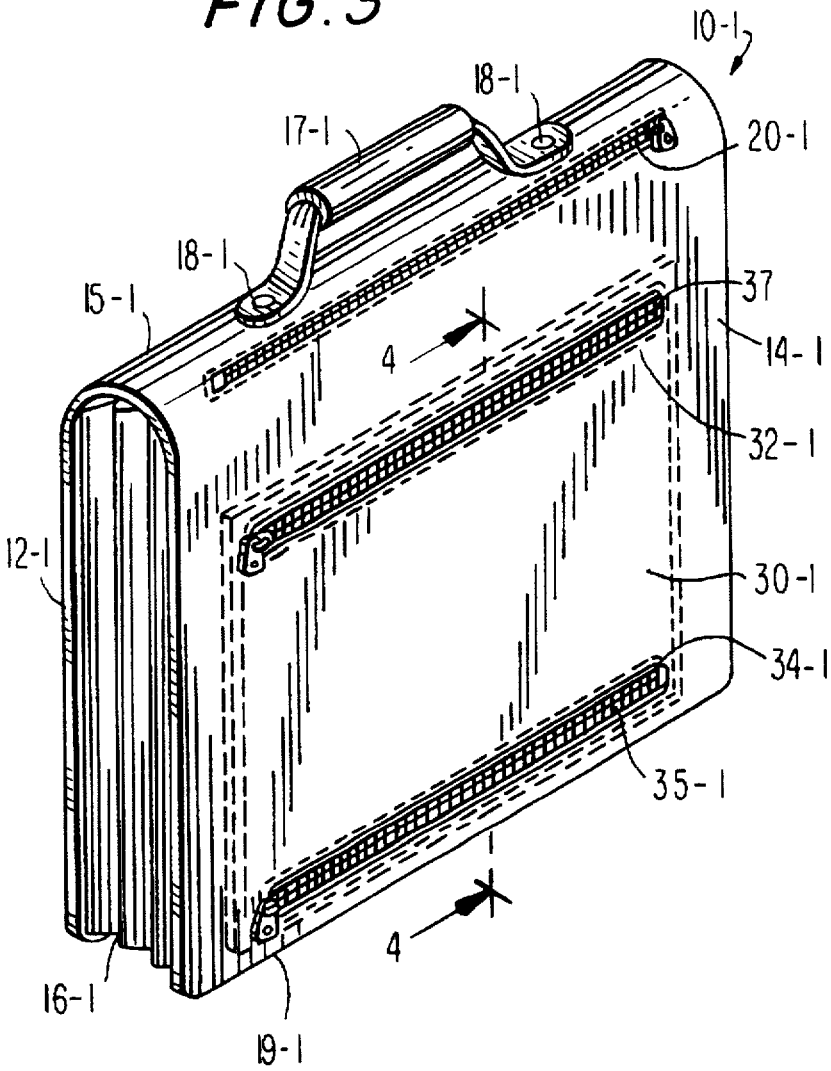
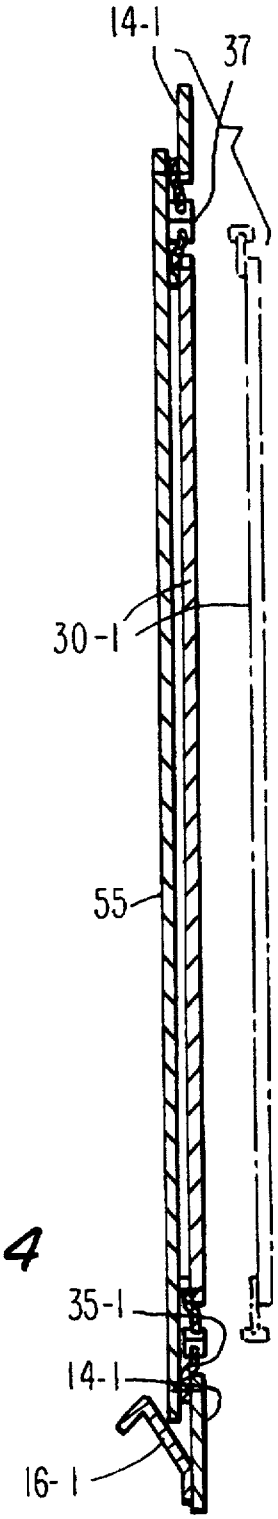
FIG. 4

ARTICLE OF LUGGAGE WITH EXTERIOR POCKET FOR ATTACHMENT TO A WHEELED CASE

FIELD OF THE INVENTION

This invention relates to an auxiliary hand article of luggage, such as a portfolio or attache case, which includes an exterior pocket configured to form a strap to be placed over the U-shaped handle typically extending upward from the top of an article of wheeled luggage. When the strap of the auxiliary article of hand luggage is placed over the U-shaped handle, the auxiliary article of luggage will be temporarily, and securely, maintained on top of the article of wheeled luggage, thereby avoiding the need to separately carry the auxiliary hand article of luggage while the article of wheeled luggage is being utilized.

BACKGROUND OF THE INVENTION

It has become quite common in recent years to provide a variety of articles of luggage with wheels at their bottom surface, and a telescoping handle which may be pulled upward to provide a generally U-shaped manual handle. When the user desires to transport such an article of luggage, such movement can be readily facilitated by moving the handle upward, tilting the unit rearward, and rolling the article of luggage to its desired location. While utilizing such a wheeled article of luggage, the user, oftentimes, has an additional, smaller auxiliary articles of luggage, such as a portfolio or attache case which may typically include working papers, newspapers, books or other articles of the type not normally packed within the larger article of wheeled luggage. While such an auxiliary article of hand luggage may typically be carried in the hand not being utilized to roll the article of wheeled luggage, because of the need to have a hand accessible while performing other tasks (e.g. carrying of outer clothing, opening of doors, carrying other articles or wheeling an additional article of wheeled luggage), the user may place the auxiliary hand article of luggage along the top surface of the article of wheeled luggage while it is being rolled. Without some means of securement, this could result in the auxiliary hand article of luggage falling off, with possible damage to its content, or inadvertent loss. Hence, it would be desirable to provide a simple means for retaining the auxiliary hand article of luggage on the wheeled article of luggage, while supporting same on top of the article of wheeled luggage.

SUMMARY AND OBJECT OF THE PRESENT INVENTION

In order to provide for desired retention of the auxiliary hand article of luggage on top of a conventional wheeled luggage product, the auxiliary hand article of luggage of the present invention includes an external strap which is appropriately configured to envelop the U-shaped handle of the article of wheeled luggage. Advantageously, the strap structure serves a dual function in that it may be selectively converted into an exterior pocket for holding articles. The pocket includes a pair of vertically-spaced and horizontally-extending upper and lower openings: Both of the openings have an open condition, with at least the lower opening including a closure means for selectively maintaining that opening in either its open or closed condition. When the closure means is in its closed condition, the bottom of the pocket will be closed, to thereby provide a readily externally accessible supplementary compartment for the reception of articles (e.g., a newspaper), with the upper opening, while in its open condition, providing access to that supplementary exterior compartment. When both the upper and lower openings are in their open condition, the material of the pocket which is intermediately the pair of openings will form an external strap. The strap will have a horizontal extent defined by the horizontal extent of the openings, and a vertical extent defined by the vertical spacing between the openings. To place the auxiliary hand article of luggage on top of the article of wheeled luggage, the U-shaped handle of the article of wheeled luggage is inserted into the bottom opening of the strap, moved along the interior wall of the strap, and exits through the top opening of the strap.

According to one embodiment of the present invention, the pocket is formed of an auxiliary member which is secured to the front or rear wall of the hand article of luggage. Alternatively, and according to another embodiment of the invention, the pair of openings forming the exteriorly accessible pocket are within either of the front or rear walls, with the portion of that wall between the pair of openings forming the requisite strap for enveloping the U-shaped handle.

It should be readily understood that it is relatively simple to modify conventional-type portfolios or attache cases to achieve the results of the present invention.

Accordingly, it is a primary object of the present invention to provide an auxiliary hand article of luggage having a simplified structure for temporarily retaining same on top of an article of wheeled luggage.

A further object of the present invention is to provide such an auxiliary hand article of luggage which includes an exterior pocket, which can be converted into a strap for emplacement over the U-shaped handle of an article of wheeled luggage.

An additional object of the present invention is to provide such an auxiliary hand article of luggage wherein the conversion of the pocket to a strap is readily accomplished by the opening of a closure means (e.g., a zipper).

These as well as further objects of the present invention will become apparent upon the consideration of the following descriptions and drawings in which:

DESCRIPTION OF THE DRAWINGS

FIG. 3 is a perspective view of an alternative form of the present invention.

FIG. 4 is a cross-sectional view along the arrows 4—4 as shown in FIG. 3.

DESCRIPTION OF THE PREFERRED EMBODIMENTS

Figure 1:
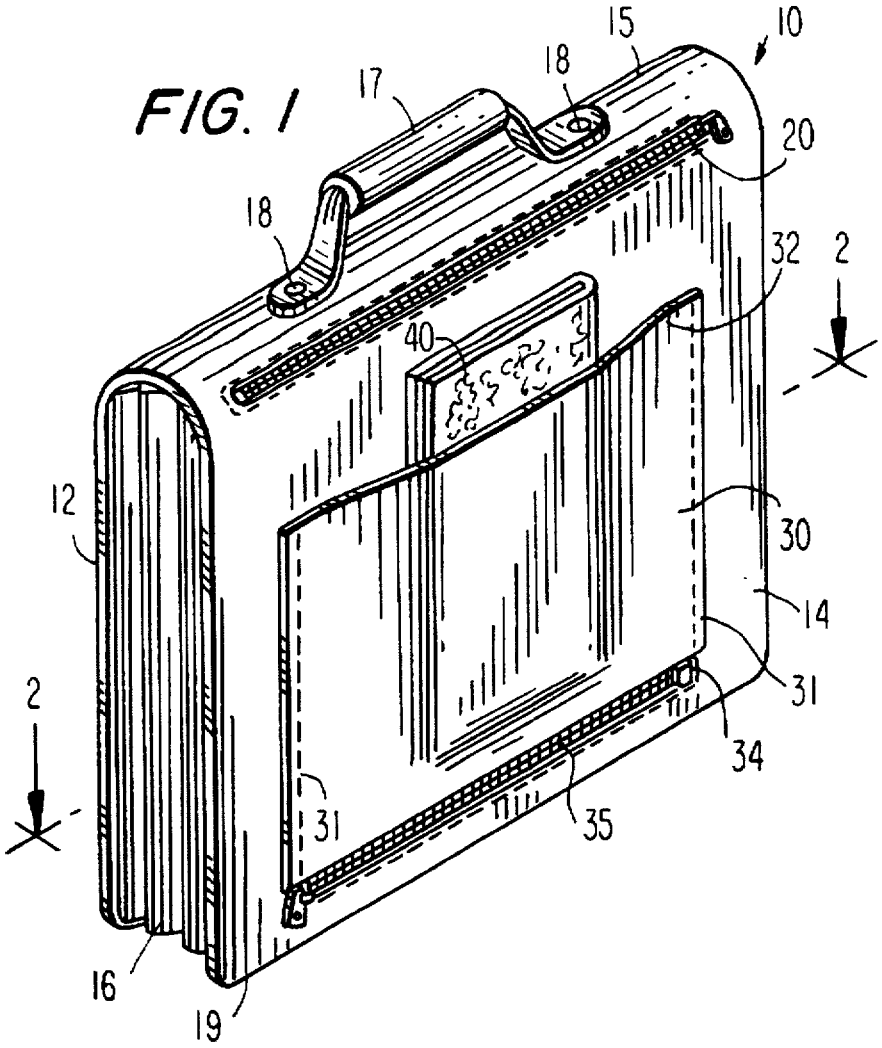
FIG. 1 is a perspective view of one form of the invention.

Reference is initially made to the embodiment shown in FIGS. 1, 2, 5 and 6.

The auxiliary hand article of luggage 10, which may typically be a portfolio, attache, or other type of business case, comprises a plurality of interconnected walls including: opposed front wall 12 and rear wall 14; top wall 15;

bottom wall 19; and side walls 16. Side walls 16 preferably include a gusset construction for appropriate expansion of the hand-held article of luggage 10, which may typically be a portfolio, attache or other type of business case, which may typically be a portfolio or attache case. The manual handle 17 is secured to the top surface 15, typically by rivets 18. The aforementioned walls collectively define an interior volume for the storage of materials. A zippered access opening 20 is provided to permit the insertion into and removal of materials from the interior volume. It should naturally be understood that this is merely typical of one form of auxiliary hand article of luggage which may include the advantageous feature of the present invention. Various modifications can be made thereto. For example, the zippered access opening 20 could be replaced with a flap. Likewise, the expansive gusset-type side wall 16 may be replaced with a fixed-size side wall.

In accordance with the present invention, an auxiliary externally accessible pocket 30 is provided along exterior of wall 14. Pocket 30 is shown as a separate member which is secured to wall 14 typically by stitching 31. The material forming auxiliary hand article luggage 10, including the auxiliary pocket 30, may typically be leather, a textile fabric, or plastic. Pocket 30 includes upper opening 32 and lower opening 34. In accordance with the present invention, lower opening 34 may be selectively opened or closed by a closure means, shown as zipper 35. Alternatively, the closure means could be in another form, such as complementary Velcro members, snaps, etc. If desired, the upper opening 32 may also include a closure member, such that when auxiliary articles, such as newspaper 40, are placed within the pocket 30, the pocket may be closed at both sides.

Figure 5:
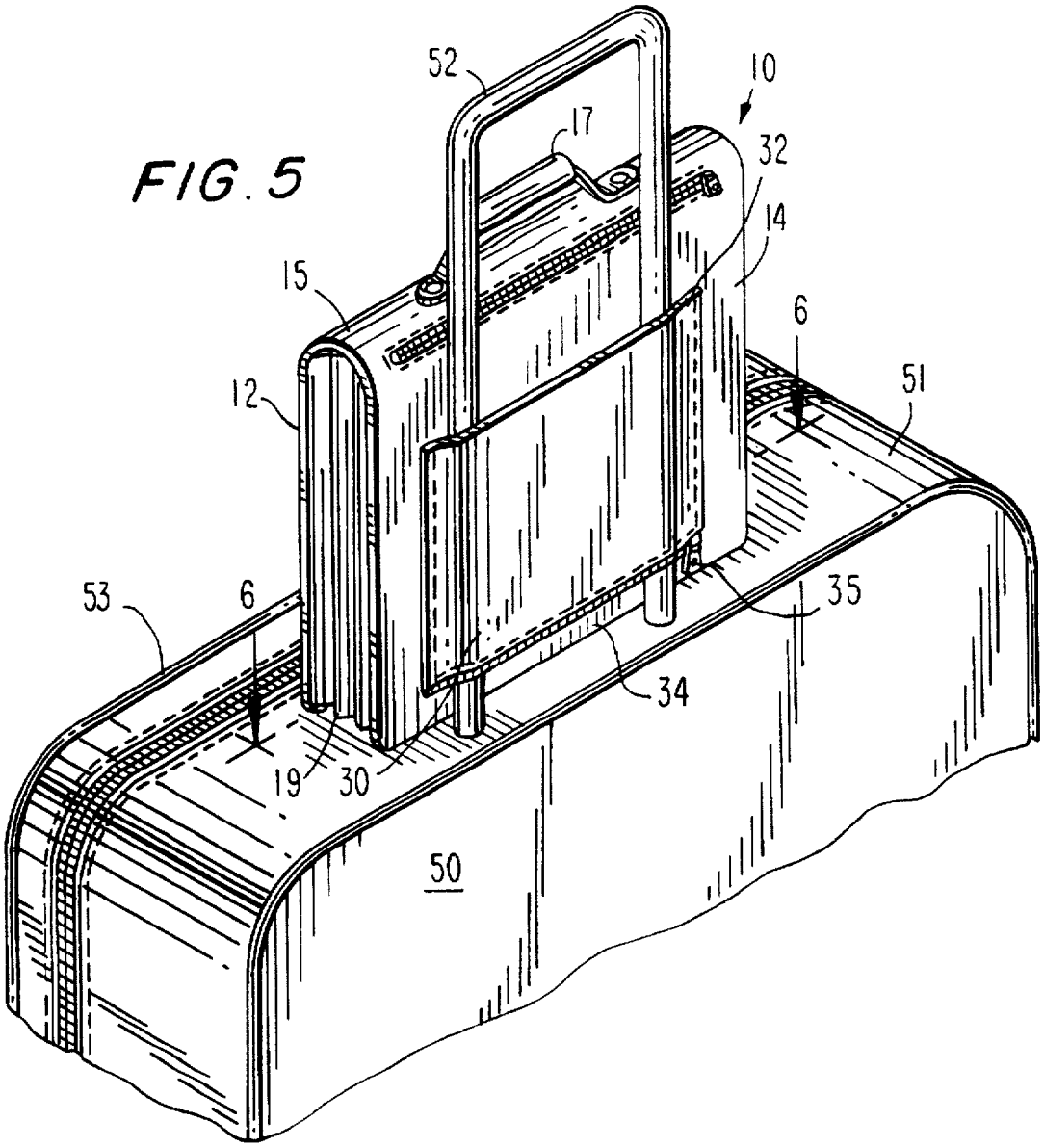
FIG. 5 is a perspective view showing the manner in which the auxiliary hand article of luggage of FIGS. 1 and 2 may be converted into a pocket, and retainingly supported on top of an article of wheeled luggage.
Figure 6:
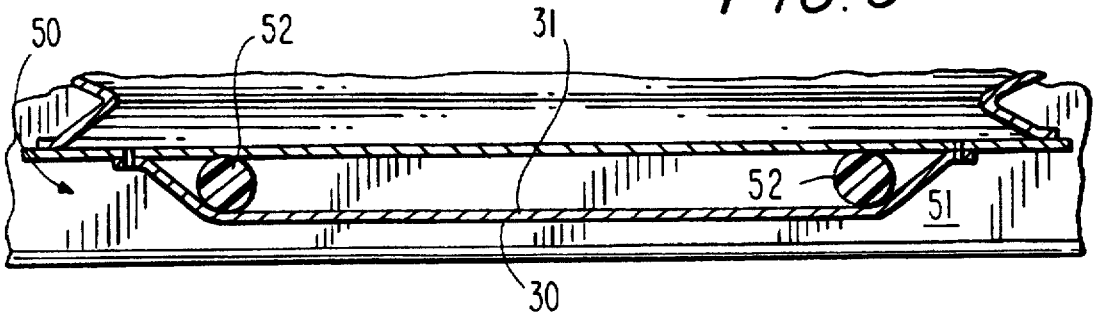
FIG. 6 is a cross-sectional view along the arrows 6—6 as shown in FIG. 5.

When it is desired to place the auxiliary hand article of luggage 10 on the top surface 51 of the article of wheeled luggage, as shown in FIGS. 5 and 6, any materials within the auxiliary pocket are removed and zipper 35 is opened, so as to open lower opening 34. Wheeled article of luggage 50 will typically have a telescoping handle 52 which, when it is desired to roll luggage 50, will be pulled upwards for manual grasping. As shown in FIG. 5, pocket 30 will now be in the form of an externally accessible strap, which is configured to tightly engage U-shaped handle 52. The horizontal extent of the upper and lower openings 32,34 may be in the order of eleven inches, and the vertical spacing being in the order of nine inches. It should naturally be understood that this is only provided for exemplary purposes, with other dimensions being selected in accordance with the anticipated size of the handle member to be placed within strap 30.

To place the auxiliary hand article of luggage on top surface 51 of the wheeled article of luggage 50, the U-shaped handle 52 first passes through the lower opening 34, then along the interior surface 31 of pocket 30, exiting at upper surface 32, such that the free end portion of U-shaped handle 52 will be readily accessible for manual grasping. It should, accordingly, be understood that as opposed to those situations where the auxiliary hand article of luggage is merely placed on top surface 51, the pocket-converted strap 30, will now provide a secure engagement therebetween, so as to prevent accidental falling of auxiliary hand article of luggage 10. Further, it should be recognized that the placement of the auxiliary hand article of luggage 10 on top of the wheeled case 50 avoids possible interference with the retention of supplementary articles of luggage along the front surface 53 thereof, as typically shown in U.S. Pat. Nos. 4,759,431 and 5,431,262.

Figure 2:
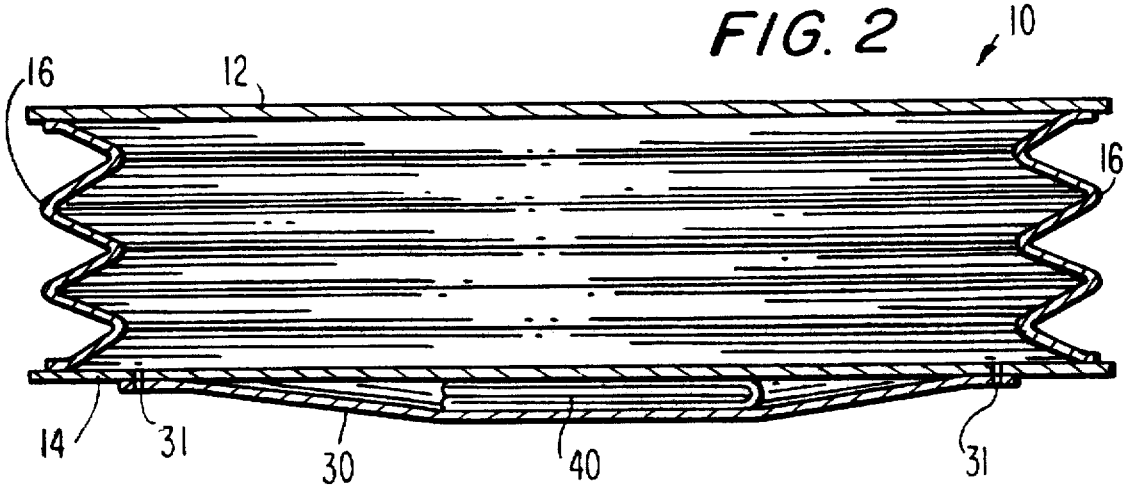
FIG. 2 is a cross-sectional view along the arrows 2—2 as shown in FIG. 1.

Reference is now made to the alternative embodiment of FIGS. 3 and 4, with those components corresponding to like components of FIGS. 1 and 2 being indicated with a "–1" designation. Instead of a separate member being secured to wall 14-1 (as in the embodiment of FIGS. 1–4), the vertically-spaced and horizontally-extending upper opening 32-1 and lower opening 34-1 which form the exterior pocket 30-1 are provided within wall 14-1. A pair of upper 37 and lower 35-1 closure means are provided for these horizontal openings. These closure means are illustratively shown as zippers. In order to isolate this exteriorly accessible pocket from the main interior volume of case 10-1, an intermediary wall 55 is provided. To insert auxiliary material (not shown) in pocket 30-1, the upper zipper 37 is opened. When it is desired to convert pocket 30-1 to a strap (as shown in the dot-dash displacement of FIG. 4) both the upper and lower zipper closures 37,35-1 are open. Any auxiliary contents within the pocket 30-1 will then be removed. The strap formed by wall section 30-1 is then placed over the U-shaped handle of the article of wheeled luggage, in the same manner as shown in FIG. 5.

It should naturally be understood that various other modifications may be made in accordance with the present invention, within the scope of the appended claims.

What is claimed is:

1. An auxiliary hand article of luggage including:

a plurality of interconnected walls, including opposed front and rear walls, with said plurality of walls collectively defining an interior volume for the storage of materials;

an access opening in one of said walls to permit the insertion into and removal of materials from said interior volume;

at least one of said front or rear walls having an externally accessible pocket;

said pocket including a pair of vertically spaced, and horizontally extending upper and lower openings;

both of said upper and lower openings having an open condition, with at least said lower opening including closure means for selectively maintaining said opening in either its open or a closed condition;

said pocket having first and second operative conditions selectively determined by the movement of said lower opening closure means between closed and open positions;

said pocket, when said lower opening closure means is in its closed condition establishing said first operative condition to provide a supplementary external compartment for the reception of materials, with said upper opening, while in its open condition, providing access to said supplementary compartment;

said lower opening closure means being manually movable to its open condition for the selective opening of said lower opening to establish said second operative condition;

the portion of said pocket intermediate said pair of openings when said pocket is in said second operative condition forming an external strap along said one of said front or rear walls when both of said upper and lower openings are in their open condition;

the horizontal extent of said strap defined by the horizontal extent of said openings, and the vertical extent of said strap defined by the vertical spacing between said pair of openings, with said strap operatively configured to provide an external retaining means to freely permit the passage along its interior surface of a U-shaped handle typically extending upward from the top of an article of wheeled luggage, with said strap enveloping the U-shaped handle to retain the auxiliary hand article of luggage on top of the article of wheeled luggage.

2. An auxiliary hand article of luggage according to claim 1, wherein said closure means is a zipper.

3. An auxiliary hand article of luggage according to claim 1, wherein said pocket is formed of an auxiliary member secured to said one of said front or rear walls, and said auxiliary member being of a vertical extent substantially equal to the horizontal spacing between said pair of openings.

4. An auxiliary hand article of luggage according to claim 3, wherein said closure means is a zipper.

5. An auxiliary hand article of luggage according to claim 1, wherein said pair of openings forming said exteriorally accessible pocket are within said one of said front or rear walls, the portion of said one wall intermediate said pair of openings forming said strap, and said pocket is positioned interior of the exterior of said one wall.

6. An auxiliary hand article of luggage according to claim 5, wherein said closure means is a zipper.

7. An auxiliary hand article of luggage according to claim 5, further including an intermediary interior wall between said one wall and said interior volume, whereby said intermediary wall isolates said interior volume from the supplementary compartment formed by the pocket in said one wall.

8. An auxiliary hand article of luggage according to claim 7, wherein the horizontal extent of both of said upper and lower openings forming said pocket is in the order of eleven inches.

9. An auxiliary hand article of luggage according to claim 7, wherein the vertical spacing between said openings forming said pocket is in the order of nine inches.

10. An auxiliary hand article of luggage according to claim 1, wherein the horizontal extent of both said upper and lower openings forming said pocket is in the order of eleven inches.

11. An auxiliary hand article of luggage according to claim 1, wherein the vertical spacing between said openings forming said pocket is in the order of nine inches.

12. An auxiliary hand article of luggage according to claim 1, which is in the form of a portfolio.

13. An auxiliary hand article of luggage according to claim 1 wherein both of said upper and lower openings include closure means.

14. An auxiliary hand article of luggage according to claim 1 wherein only said lower opening includes closure means.

15. In combination, an article of wheeled luggage and an auxiliary carrying case:

said article of wheeled luggage including a storage volume, a plurality of wheels at its lower surface, and a manually graspable, generally U-shaped handle, extending from its upper surface;

said auxiliary carrying case including a plurality of walls including opposed front and rear walls, with said plurality of walls collectively defming an interior volume for the storage of materials;

an access opening in one of said walls to permit the insertion and removal of materials;

at least one of said front or rear walls having an externally accessible pocket;

said pocket including a pair of vertically spaced, and horizontally extending upper and lower openings, both of said openings have an open condition, and at least said lower opening including closure means for maintaining said opening in either its open or a closed condition;

said pocket having first and second operative conditions selectively determined by the movement of said lower opening closure means between closed and open positions;

said pocket, when said lower opening closure means is in its closed condition establishing said first operative condition to provide a supplementary external compartment for the reception of materials, with said upper opening, while in its open condition, providing access to said supplementary compartment;

said closure means being manually movable to an open condition for the selective opening of said lower opening to establish said second operative condition; the portion of said pocket intermediate said pair of openings, when said pocket is in said second operative condition forming an external strap when both of said openings are in the open condition;

the horizontal extent of said strap defined by the horizontal extent of said openings and exceeding the width of said U-shaped handle;

the vertical extent of said strap defined by the vertical spacing between said pair of openings with said strap when said pocket is in said second operative condition forming a retaining means configured to freely permit the passage therethrough, along its interior surface, of said U-shaped handle, with said strap enveloping said U-shaped handle to retain the auxiliary carrying case on top of the article of wheeled luggage.

16. The combination of claim 15, wherein said pocket is formed of an auxiliary member secured to said one of said front or rear walls, and said auxiliary member being of a vertical extent equal to the horizontal spacing between said pair of openings.

17. The combination of claim 16, wherein the horizontal extent of both said upper and lower openings forming said pocket is in the order of eleven inches.

18. The combination of claim 15, wherein said pair of openings forming said exteriorally accessible pocket are within said one of said front or rear walls, the portion of said one wall intermediate said pair of openings forming said strap, and said pocket is positioned interior of the exterior of said one wall.

19. The combination of claim 18, farther including an intermediary interior wall between said one wall and interior volume, whereby said intermediary wall isolates said interior volume from the pocket formed in said one wall.

20. The combination of claim 15, wherein the horizontal extent of both said upper and lower openings forming said pocket is in the order of eleven inches.

21. The combination claim 15, wherein said closure means is a zipper.

22. The combination of claim 15, wherein said hand article of luggage is in the form of a portfolio.

* * * * *